US011339968B2

(12) United States Patent
Theuer et al.

(10) Patent No.: US 11,339,968 B2
(45) Date of Patent: May 24, 2022

(54) DUAL FUEL LANCE WITH COOLING MICROCHANNELS

(71) Applicant: General Electric Company, Schenectady, NY (US)

(72) Inventors: Andre Theuer, Baden (CH); Nico Biagioli, Baden (CH); Mario Pudrlja, Karlovac (HR); Rohit Madhukar Kulkarni, Villnachern (CH)

(73) Assignee: General Electric Company, Schenectady, NY (US)

( * ) Notice: Subject to any disclaimer, the term of this patent is extended or adjusted under 35 U.S.C. 154(b) by 344 days.

(21) Appl. No.: 16/528,927

(22) Filed: Aug. 1, 2019

(65) Prior Publication Data

US 2020/0072469 A1 Mar. 5, 2020

Related U.S. Application Data

(60) Provisional application No. 62/724,784, filed on Aug. 30, 2018.

(51) Int. Cl.
*F23R 3/28* (2006.01)
*F23R 3/36* (2006.01)
(Continued)

(52) U.S. Cl.
CPC ..... *F23R 3/286* (2013.01); *F23R 3/283* (2013.01); *F23R 3/36* (2013.01);
(Continued)

(58) Field of Classification Search
CPC .. F23R 3/286; F23R 3/283; F23R 3/16; F23R 3/08; F23R 3/36; F23R 2900/03341;
(Continued)

(56) References Cited

U.S. PATENT DOCUMENTS 5,181,379 A * 1/1993 Wakeman ..... F02K 1/822 60/766
8,281,594 B2 * 10/2012 Wiebe ..... F23D 11/36 60/733

(Continued)

*Primary Examiner* — Gerald L Sung
*Assistant Examiner* — Rene D Ford
(74) *Attorney, Agent, or Firm* — Charlotte C. Wilson; James Pemrick

(57) ABSTRACT

A lance for a burner includes an innermost conduit defining a first fluid passage and a plurality of first fuel injection channels, each first fuel injection channel terminating at a first outlet; an intermediate conduit circumferentially surrounding the innermost conduit, the intermediate conduit defining a second fluid passage and a plurality of second fuel injection channels, each second fuel injection channel terminating at a second outlet; an outermost conduit circumferentially surrounding the intermediate conduit, the outermost conduit defining a third fluid passage, a plurality of third air outlets through the outermost conduit and surrounding the first outlets, a plurality of fourth air outlets through the outermost conduit and surrounding the second outlets, and a plurality of cooling microchannels; wherein each cooling microchannel includes and extends between a microchannel inlet in fluid communication with the third fluid passage and a microchannel outlet on an outer surface of the outermost conduit.

19 Claims, 9 Drawing Sheets

(51) Int. Cl.
*F23R 3/16* (2006.01)
*F23R 3/08* (2006.01)

(52) U.S. Cl.
CPC ..... *F23C 2900/07021* (2013.01); *F23R 3/08* (2013.01); *F23R 3/16* (2013.01)

(58) Field of Classification Search
CPC ..... F23R 3/34; F23C 2900/07021; F23D 17/002; F23D 2204/10; F23D 2209/00; F05D 2240/35
See application file for complete search history.

(56) References Cited

U.S. PATENT DOCUMENTS 8,572,980 B2 * 11/2013 Winkler ..... F23R 3/34 60/742
8,943,831 B2 * 2/2015 Eroglu ..... F23R 3/36 60/740

* cited by examiner

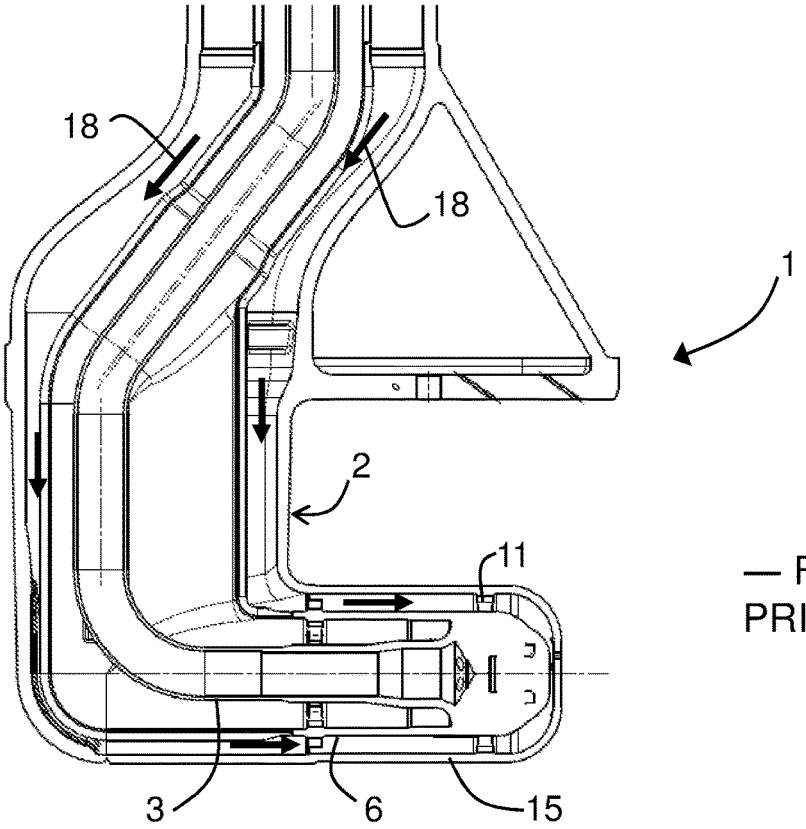
— FIG. 1 —
PRIOR ART
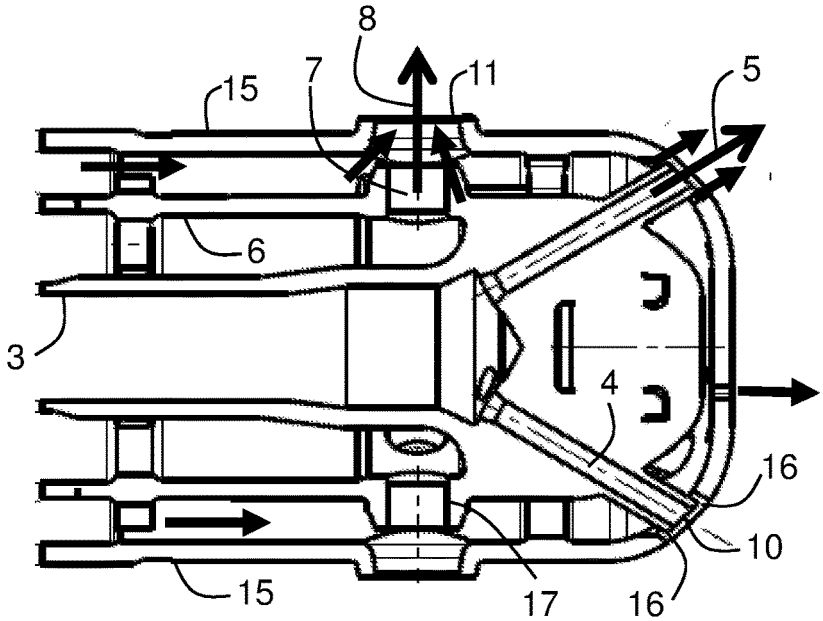
— FIG. 2 —
PRIOR ART

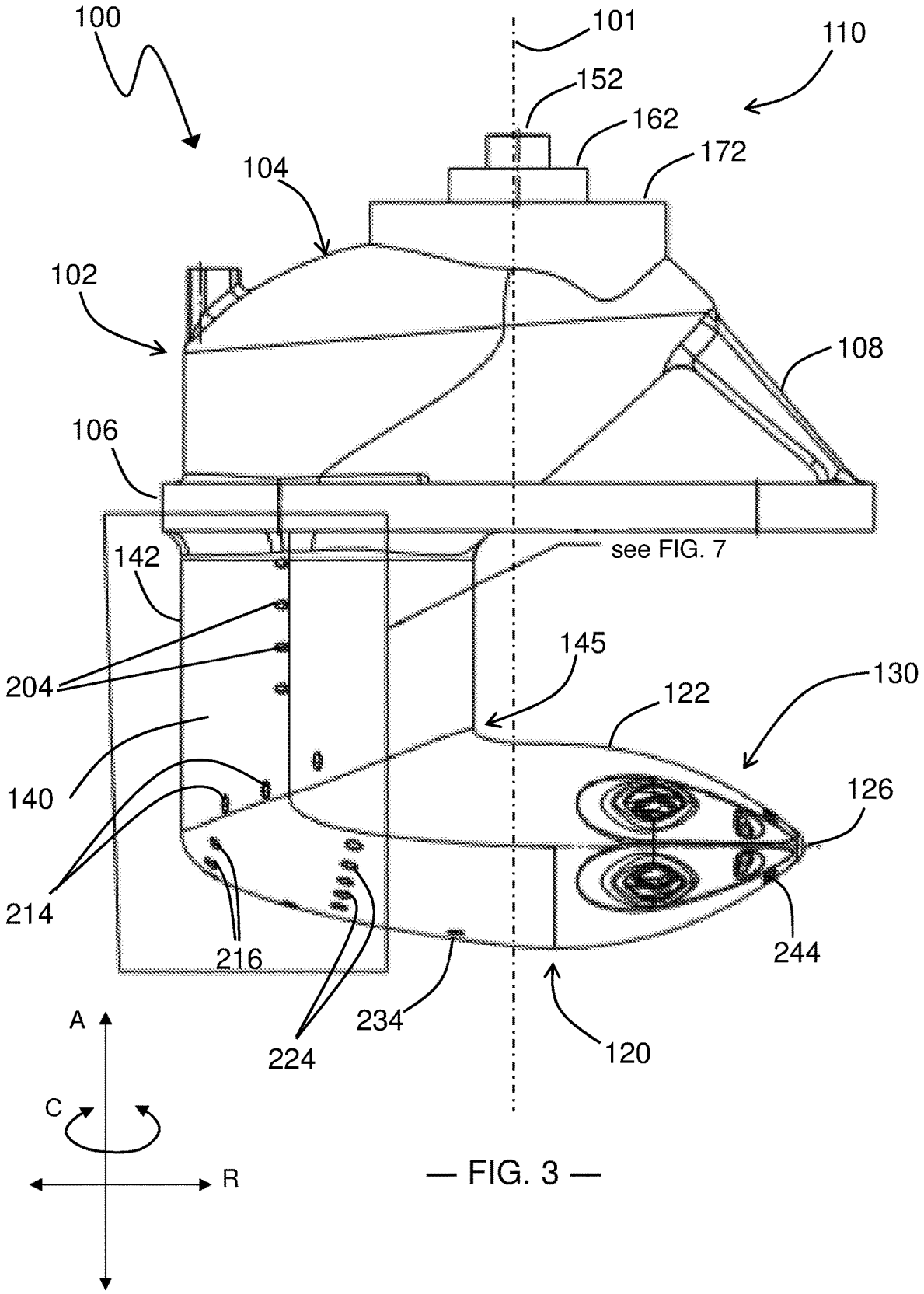
— FIG. 3 —

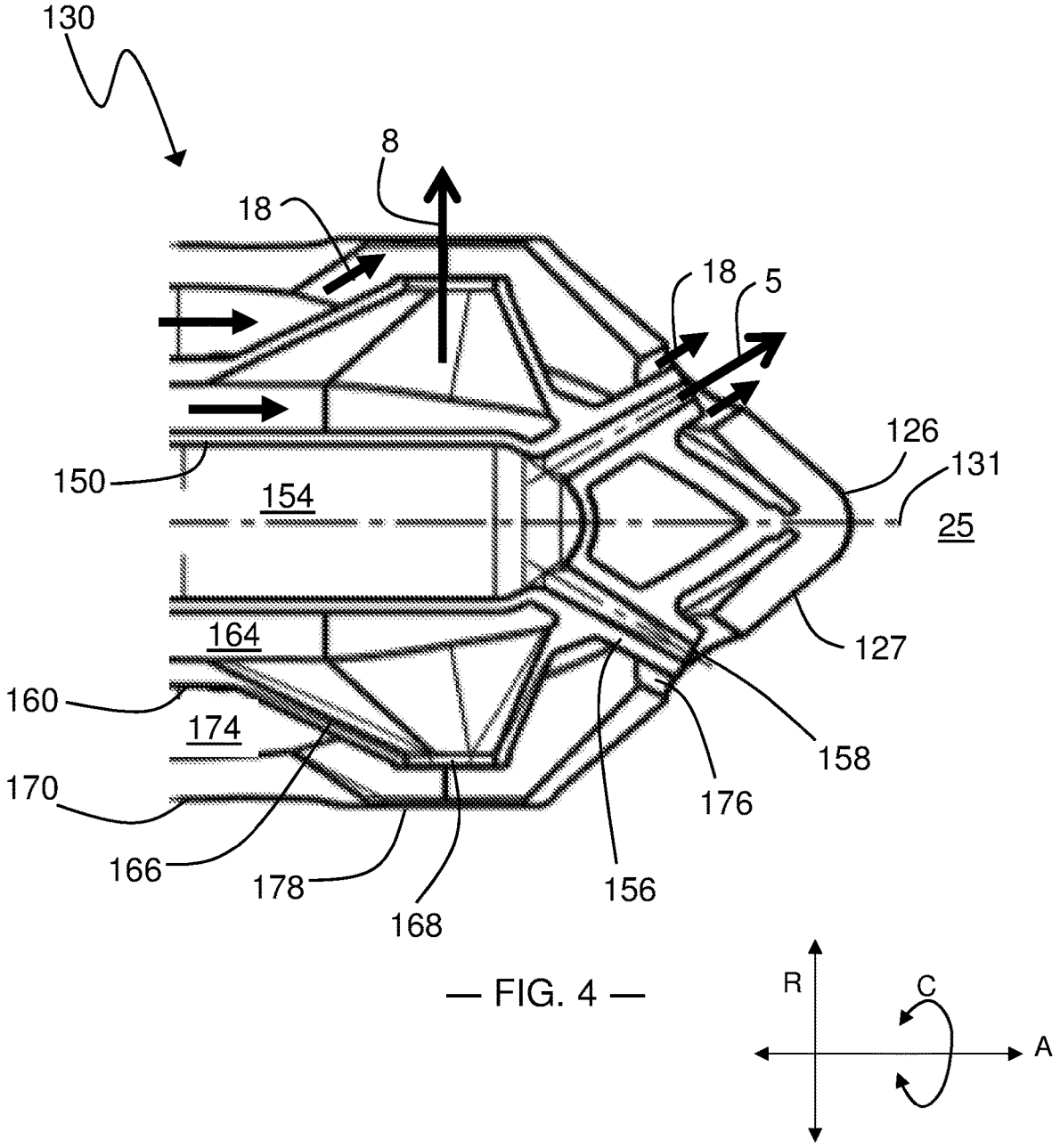
— FIG. 4 —

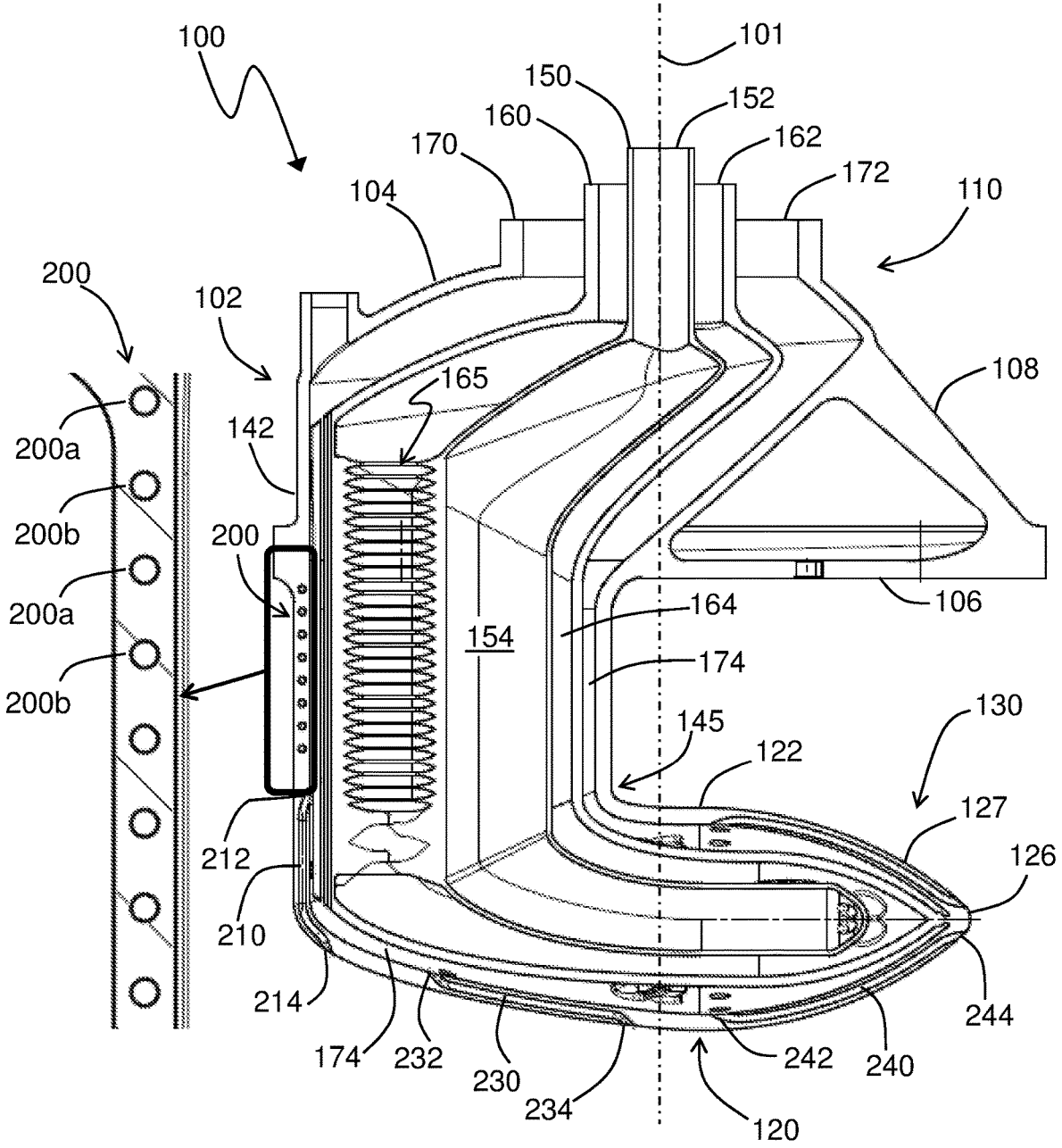
— FIG. 5 —

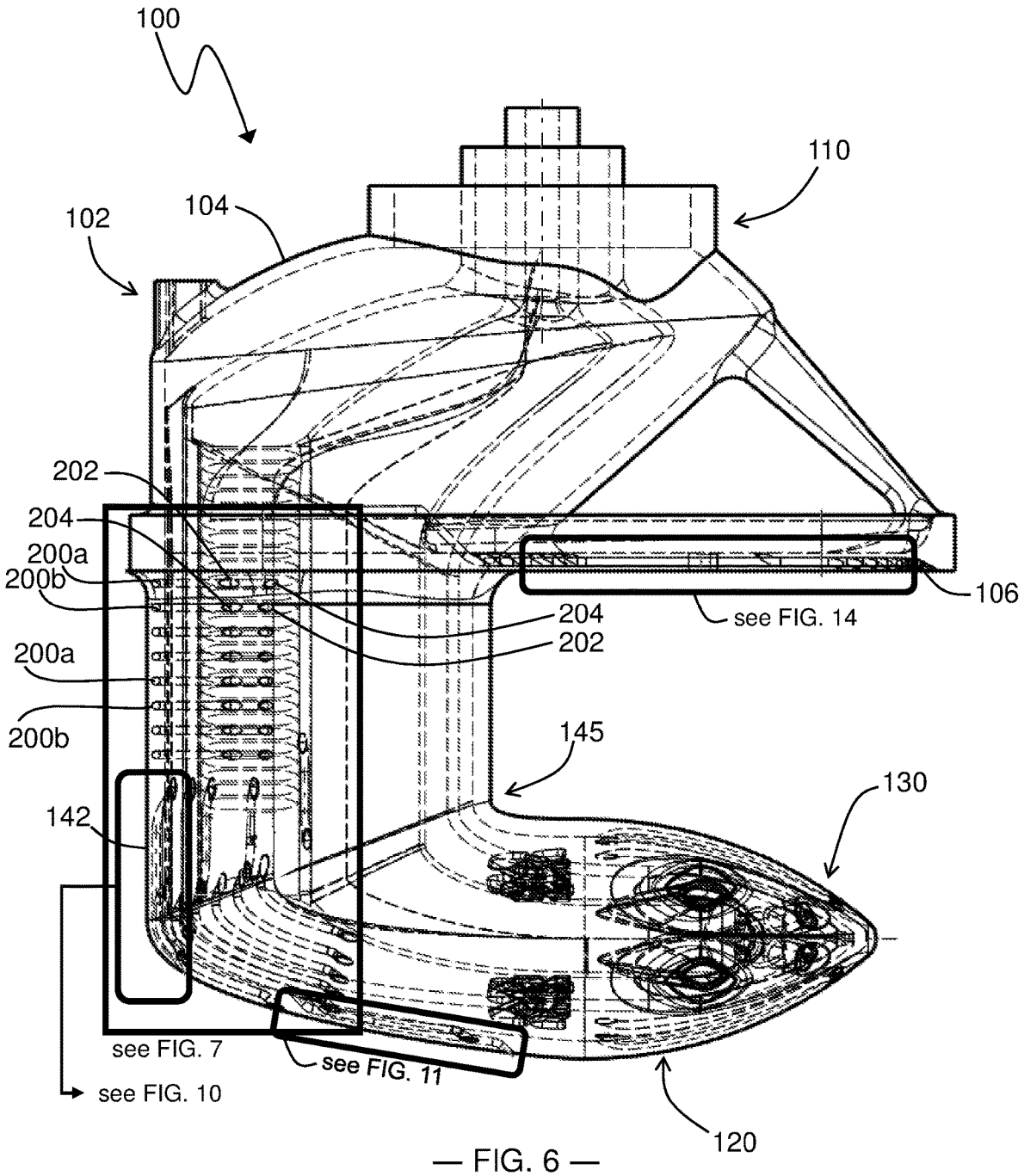
— FIG. 6 —

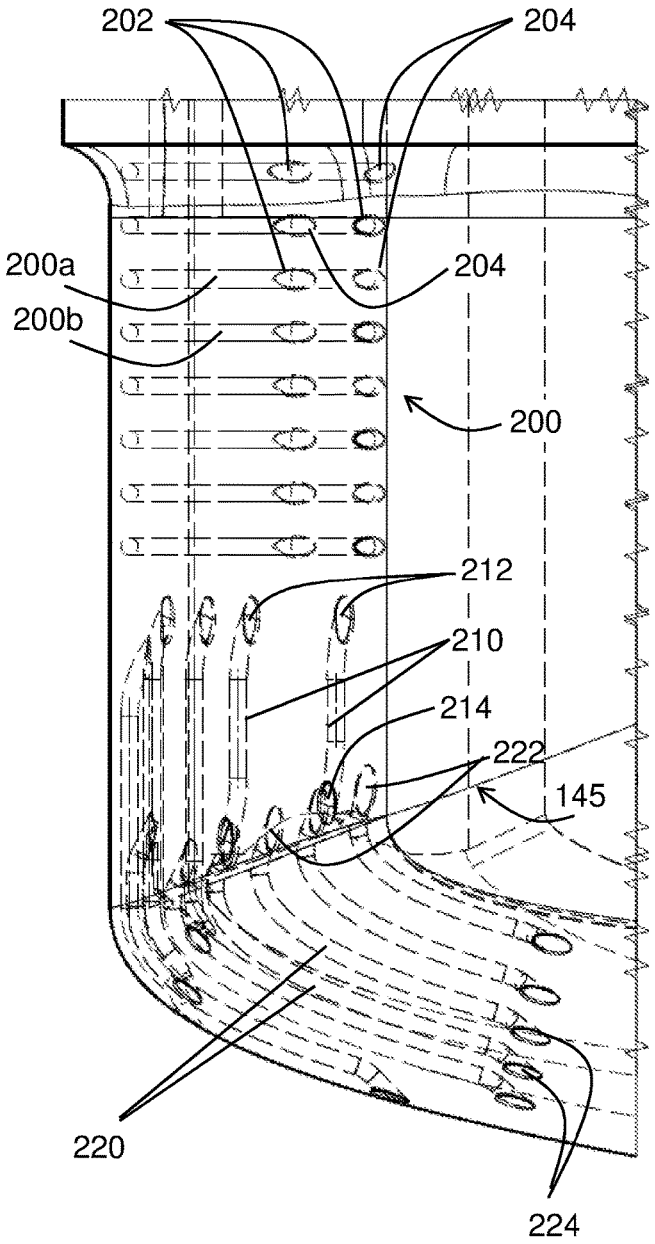
— FIG. 7 —
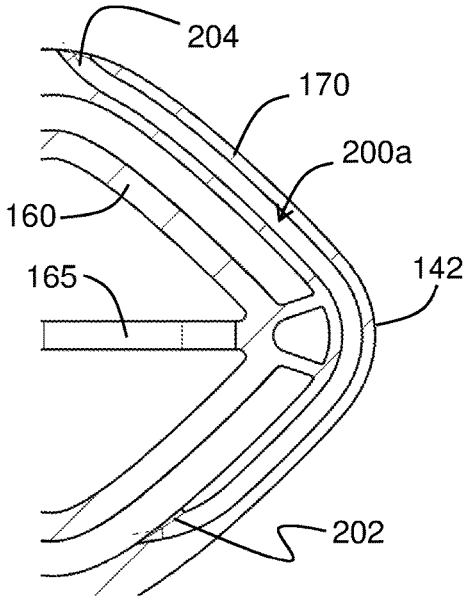
— FIG. 8 —
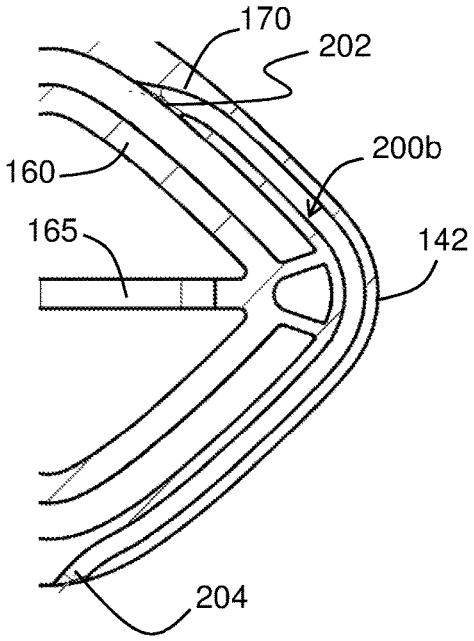
— FIG. 9 —

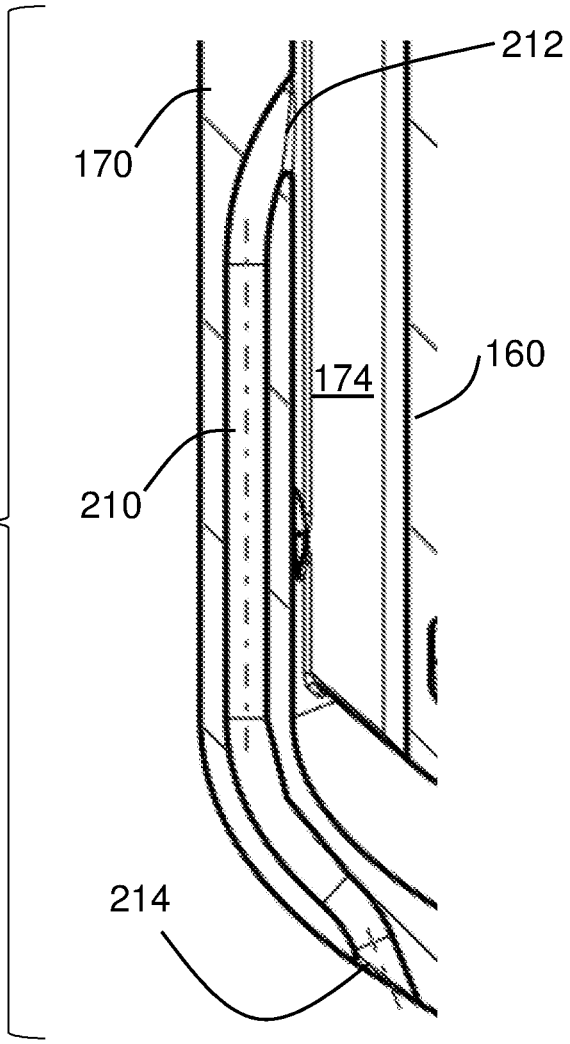
— FIG. 10 —
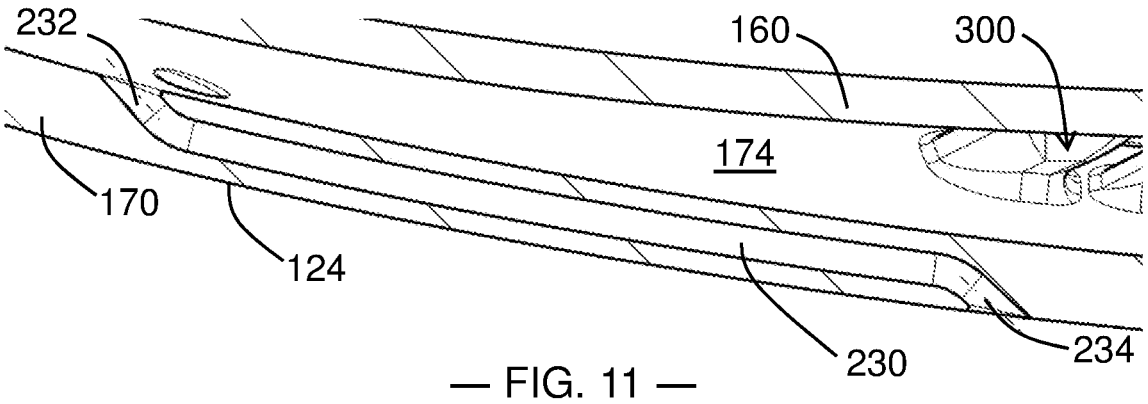
— FIG. 11 —

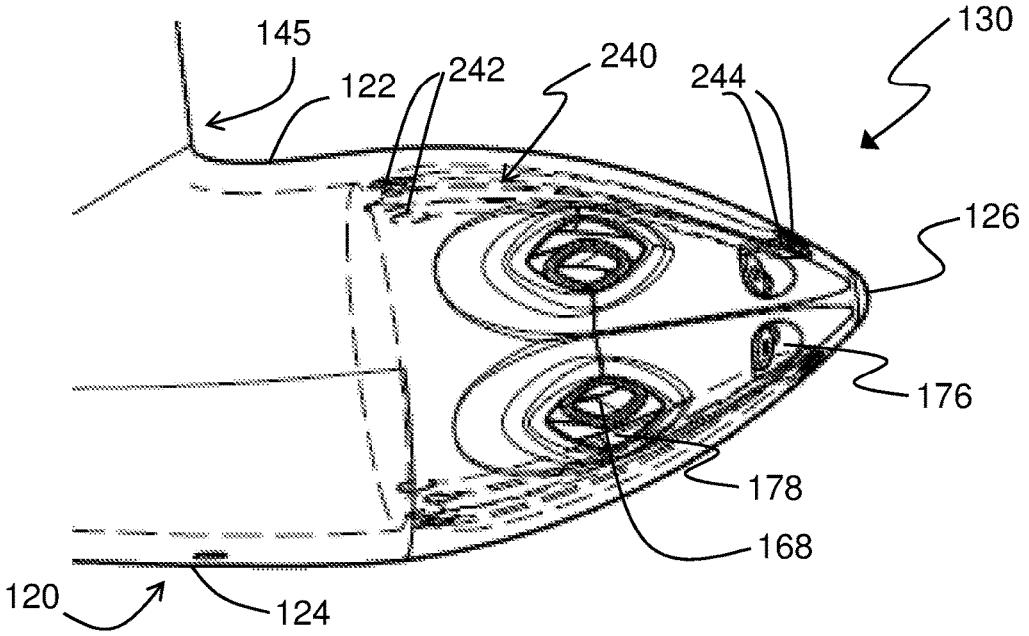
— FIG. 12 —
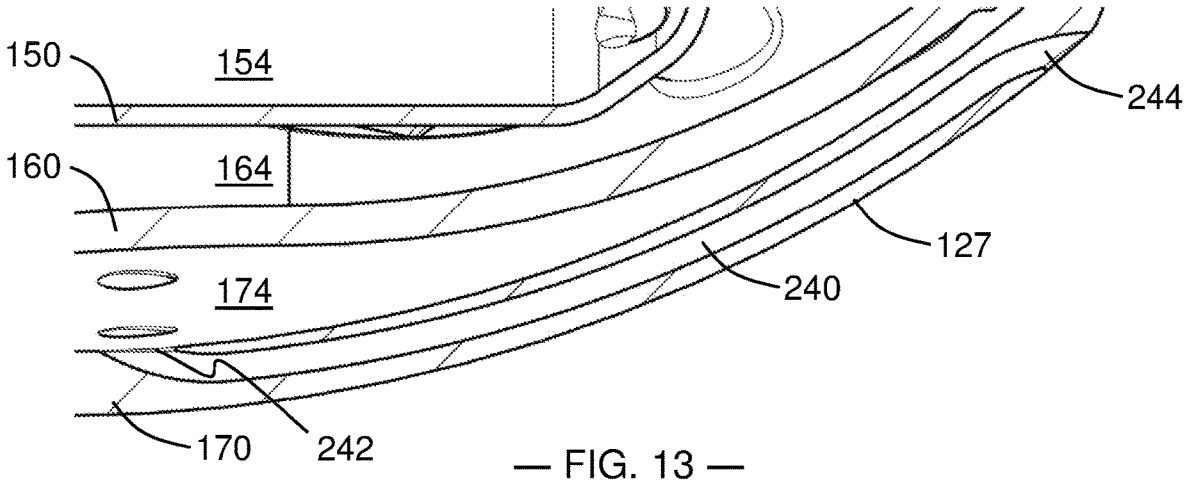
— FIG. 13 —
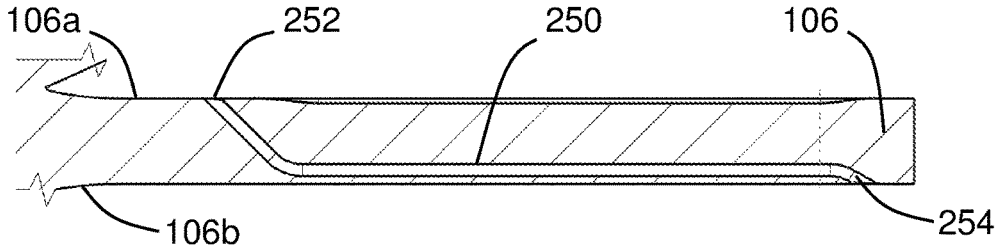
— FIG. 14 —

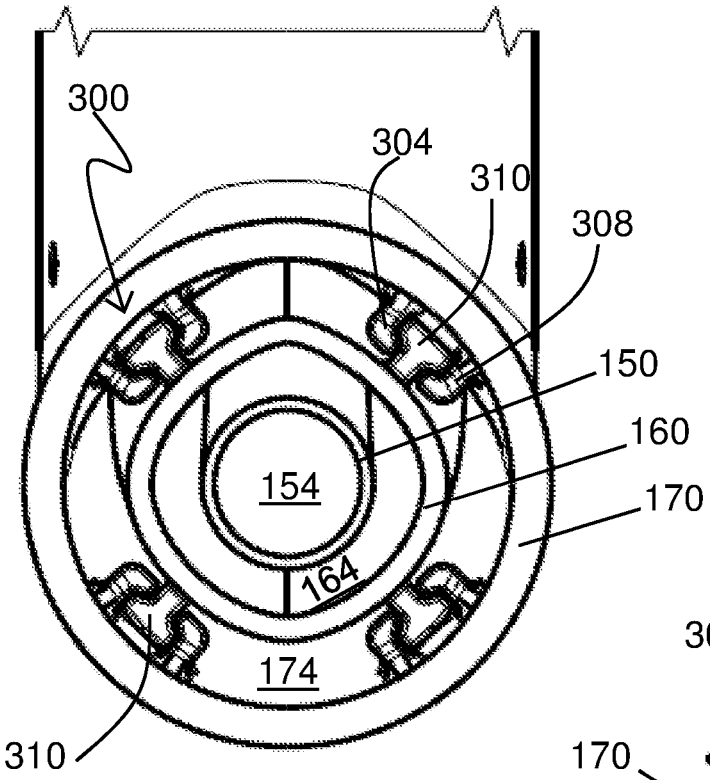
— FIG. 15 —
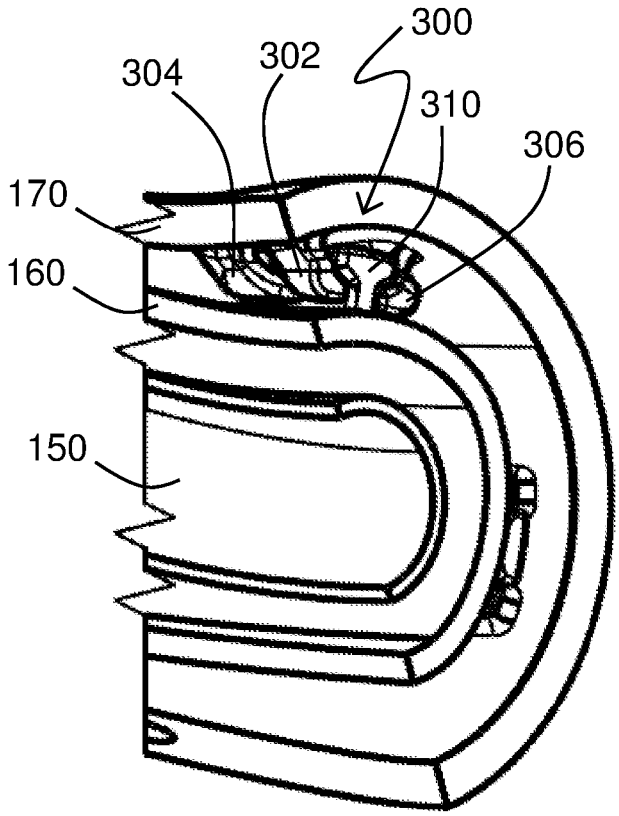
— FIG. 16 —

DUAL FUEL LANCE WITH COOLING MICROCHANNELS

TECHNICAL FIELD

The present disclosure relates to a lance of a burner, such as may be used to inject a liquid fuel or a gaseous fuel into a reheat burner of a sequential combustion gas turbine. The lance includes cooling microchannels and a tip having a shape generally resembling a prolate spheroid.

BACKGROUND

Some gas turbines used for electrical power generation include a sequential combustion system, in which combustion products from a first annular combustor pass through a first turbine section before being introduced into a second (reheat) annular combustor. In the second combustor, reheat burners introduce additional gaseous or liquid fuel into an annular combustion chamber, where it is ignited by the combustion products received from the first turbine section. The resulting combustion products are directed into a second turbine section, where they are used to drive the rotation of the turbine blades about a shaft coupled to a generator.

The fuel is introduced into the mixing chamber of the second combustor by lances configured for dual-fuel operation (that is, operating alternately on a gaseous fuel and on a liquid fuel). One example of such a lance is described in U.S. Pat. No. 8,943,831 to EROGLU et al. As shown in FIGS. 1 and 2, the lance 1 includes a body 2 defining a first duct 3 with first injection passages 4 for injecting a liquid fuel 5 and a second duct 6 with second injection passages 7 for injecting a gaseous fuel 8. The second duct 6 co-axially surrounds the first duct 3. The body 2 further includes a third duct 15 that co-axially surrounds the second duct 6. The third duct 15 includes third and fourth injection passages 16, 17 for injecting air 18.

The outlets 10 of the first injection passages 4 are axially shifted with respect to the outlets 11 of the second injection ports 7. The third injection passages 16 co-axially surround the outlet ends 10 of the first injection passages 4, and the fourth injection passages 17 co-axially surround the outlets 11 of the second injection passages 7. The third injection passages 16 are defined by holes in the wall of the third duct 15, thus defining a gap around the outlets 10 of each first injection passage 4.

Because the lance is disposed within the hot gas flow path of combustion products passing through the first combustor and the first turbine section, it is necessary to cool the lance to prevent damage and to extend service life. In the EROGLU patent, the air 18 passing through the third duct 15 is used to convectively cool the lance. However, such cooling air 18 must be at a sufficiently low temperature and a sufficiently high pressure to achieve the necessary cooling. Achieving the necessary pressure and temperature in the cooling air 18 may require the use of compressors (or booster compressors) and/or heat exchangers, which are parasitic loads that reduce undesirably the overall operational efficiency of the gas turbine.

Therefore, it would be useful to provide a lance for a secondary burner, which maintains the desired dual-fuel capability of the lance and which is configured to cool the lance using air at a lower pressure and/or a higher temperature, thereby improving turbine efficiency.

SUMMARY

A lance for a burner includes an innermost conduit defining a first fluid passage and a plurality of first fuel injection channels, each first fuel injection channel terminating at a first outlet; an intermediate conduit circumferentially surrounding the innermost conduit, the intermediate conduit defining a second fluid passage and a plurality of second fuel injection channels, each second fuel injection channel terminating at a second outlet; an outermost conduit circumferentially surrounding the intermediate conduit, the outermost conduit defining a third fluid passage, a plurality of third air outlets through the outermost conduit and surrounding the first outlets, a plurality of fourth air outlets through the outermost conduit and surrounding the second outlets, and a plurality of cooling microchannels; wherein each cooling microchannel includes and extends between a microchannel inlet in fluid communication with the third fluid passage and a microchannel outlet on an outer surface of the outermost conduit.

BRIEF DESCRIPTION OF THE DRAWINGS

The specification, directed to one of ordinary skill in the art, sets forth a full and enabling disclosure of the present system and method, including the best mode of using the same. The specification refers to the appended figures, in which:

FIG. 1 is a cross-sectional side view of a conventional burner lance for a gas turbine combustor;

FIG. 2 is a cross-sectional side view of a tip of the burner lance of FIG. 1;

FIG. 3 is a side view of a burner lance of a gas turbine combustor, according to the present disclosure;

FIG. 4 is a cross-sectional side view of a tip of the burner lance of FIG. 3;

FIG. 5 is a cross-sectional side view of the burner lance of FIG. 3 with a call-out of inlet ports to a first set of cooling microchannels;

FIG. 6 is a side view of the burner lance of FIG. 3, which illustrates the cooling microchannels disposed within the burner lance;

FIG. 7 is a side view of one portion of the burner lance of FIG. 3, which illustrates the cooling microchannels disposed along the upstream surface of the burner lance;

FIG. 8 is a side view of a first cooling microchannel, as disposed in a first direction around an upstream surface of the present burner lance, according to an aspect of the present disclosure;

FIG. 9 is a side view of a second cooling microchannel, as disposed in a second direction around an upstream surface of the present burner lance, according to an aspect of the present disclosure;

FIG. 10 is a side view of a first cooling microchannel, shown in FIG. 7 as disposed along an upstream surface of the burner lance, according to one aspect of the present disclosure;

FIG. 11 is a side view of a second cooling microchannel, as disposed along a bottom surface of the burner lance, according to another aspect of the present disclosure;

FIG. 12 is a side perspective view of the tip portion of the burner lance of FIG. 3, which illustrates the cooling microchannels disposed along the tip;

FIG. 13 is a side view of one of the cooling microchannels of FIG. 12, as disposed along a bottom surface of the tip of the present burner lance, according to another aspect of the present disclosure;

FIG. 14 is a side view of a sixth cooling microchannel, as disposed along a balcony of the present burner lance, according to yet another aspect of the present disclosure;

FIG. 15 is a cross-sectional view of the tip of the present burner lance, as taken along the longitudinal axis, which illustrates circumferentially spaced retention features; and FIG. 16 is a perspective side view of the retention features of FIG. 15.

DETAILED DESCRIPTION

Reference will now be made in detail to various embodiments of the present disclosure, one or more examples of which are illustrated in the accompanying drawings. The detailed description uses numerical and letter designations to refer to features in the drawings. Like or similar designations in the drawings and description have been used to refer to like or similar parts of the disclosure.

To clearly describe the present burner lance with dual fuel capability and microchannel cooling and the features thereof, certain terminology will be used to refer to and describe relevant machine components within the scope of this disclosure. To the extent possible, common industry terminology will be used and employed in a manner consistent with the accepted meaning of the terms. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single integrated part.

In addition, several descriptive terms may be used regularly herein, as described below. The terms "first", "second", and "third" may be used interchangeably to distinguish one component from another and are not intended to signify location or importance of the individual components.

As used herein, "downstream" and "upstream" are terms that indicate a direction relative to the flow of a fluid, such as the working fluid through the turbine engine. The term "downstream" corresponds to the direction of flow of the fluid, and the term "upstream" refers to the direction opposite to the flow (i.e., the direction from which the fluid flows. The term "inner" is used to describe components in proximity to the longitudinal axis or center of a component, while the term "outer" is used to describe components distal to the longitudinal axis or center of a component.

It is often required to describe parts that are at differing radial, axial and/or circumferential positions. As shown in FIG. 3, the "A" axis represents an axial orientation. As used herein, the terms "axial" and/or "axially" refer to the relative position/direction of objects along axis A, which extends along the length of the part through a centerline of the fluid inlets (as shown in FIG. 3). As further used herein, the terms "radial" and/or "radially" refer to the relative position or direction of objects along an axis "R", which intersects axis A at only one location. In some embodiments, axis R is substantially perpendicular to axis A. Finally, the term "circumferential" refers to movement or position around axis A (e.g., axis "C"). The term "circumferential" may refer to a dimension extending around a center of a respective object (e.g., a rotor or a longitudinal axis of a part).

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents.

Although exemplary embodiments of the present disclosure will be described generally in the context of manufacturing turbine nozzles for a land-based power-generating gas turbine for purposes of illustration, one of ordinary skill in the art will readily appreciate that embodiments of the present disclosure may be applied to other locations within a turbomachine and are not limited to turbine components for land-based power-generating gas turbines, unless specifically recited in the claims.

Referring now to the drawings, FIG. 3 illustrates a lance 100, according to the present disclosure. The lance 100 includes a body 102 having a longitudinal axis 101, an upstream (inlet) portion 110, and a downstream portion 120 including a tip portion 130. An arcuate upper portion 104 extends between the inlet portion 110 and a balcony 106 that is generally horizontal and that is transverse to the longitudinal axis. A support brace 108 connects the inlet portion 110 to the balcony 106 opposite the arcuate upper portion 104. A middle portion 140 extends axially between the balcony 106 and the downstream portion 120. The downstream portion 120 has the general shape of a prolate spheroid (i.e., the shape of a rugby ball or an American football), having a curved upper surface 122 and a curved lower surface 124 that are joined at the lance tip 126.

Unlike conventional lances that have a cylindrical surface (as shown in FIG. 1), the downstream portion of the present lance 100 has a curved lower surface 124. The curved upper surface 122 and the curved lower surface 124 improve cooling air flow within and around the downstream portion 120 and the tip portion 130, promote the flow of combustion products around the lance 100, and prevent the ingestion of hot combustion gases into the tip portion 130.

The interior of the tip portion 130 is shown in FIG. 4. An innermost conduit 150 defines a passage 154 for the delivery of liquid fuel 5 (or a liquid fuel/water emulsion) to the liquid fuel injection channels 156 that are disposed at an acute angle relative to an axial centerline 131 of the tip portion 130. Each liquid fuel injection channel 156 may include a slight taper from the passage 154 to its outlet 158, in which case the liquid fuel 5 will be accelerate as the liquid fuel 5 is injected through the outlet 158. The outlets 158 are flush with, or slightly inboard of, the surface 127 of the tip portion 130. The surface 127 is a portion of the upper curved surface 122 or the lower curved surface 124 of the downstream portion 120 of the lance 100.

An intermediate conduit 160 circumferentially surrounds the innermost conduit 150 and defines a passage 164 for the delivery of gaseous fuel 8 to the gaseous fuel injection channels 166 whose outlets are disposed at an approximately 90-degree angle (±10 degrees) relative to the axial centerline 131. The gaseous fuel injection channels 166 are generally frusto-conical in shape and, in the illustrated embodiment, are asymmetrical about an exit axis (represented by the arrow 8). The outlets 168 of the gaseous fuel injection channels 166 are larger in cross-sectional area than the outlets 158 of the liquid fuel injection channels 156. The outlets 168 are slightly inward of the surface 127 of the tip portion 130.

An outermost conduit 170 circumferentially surrounds the intermediate conduit 160 and defines the body 102 of the lance 100. The outermost conduit 170 defines a passage 174 for delivery of compressed cooling air 18 to a first set of air outlets 176 and a second set of air outlets 178, which provide for fluid communication through the lance tip 126 and into the combustion zone 25. As the compressed cooling air 18 is conveyed through the outermost conduit 170, the body 102 (including the downstream portion 120 and the tip portion 130) is convectively cooled.

The first set of air outlets 176 are disposed around the liquid fuel outlets 158 and help to cool the liquid fuel channels 156, thereby preventing coking. Additionally, the air outlets 176 may help to atomize the liquid fuel 5 as the liquid fuel 5 is injected. The second set of air outlets are disposed around the gaseous fuel outlets 168 and provide air 18 that mixes with the gaseous fuel 8 as the gaseous fuel 8 is introduced into the combustion zone 25. Such mixing helps to reduce emissions of nitrous oxides (NOx).

The concentric conduits 150, 160, 170 are shown in their entirety in FIG. 5. As shown, the inlet portion 110 defines three co-axial conduit inlets 152, 162, 172 disposed about the longitudinal axis 101 of the body 102. Each conduit 150, 160, 170 has an inlet 152, 162, 172 parallel to the longitudinal axis 101; an upstream arcuate portion in communication with a respective inlet 152, 162, 172; a vertically oriented passage in the middle portion 140 of the body 102 in communication with the upstream arcuate portion; and a downstream portion disposed in an orientation transverse to the longitudinal axis 101 and in communication with the vertically oriented passage.

The unique geometry of the present lance 100 with its intricate pattern of microchannels, as will be discussed below, may be efficiently produced by an additive manufacturing process. In such case, the vertically oriented passage of the gaseous fuel conduit 160 may be provided with a stacked arrangement of ribs 165 to facilitate manufacturing.

The additive manufacturing process includes any manufacturing method for forming the lance 100 and its cooling features through sequentially and repeatedly depositing and joining material layers. Suitable manufacturing methods include, but are not limited to, the processes known to those of ordinary skill in the art as Direct Metal Laser Melting (DMLM), Direct Metal Laser Sintering (DMLS), Laser Engineered Net Shaping, Selective Laser Sintering (SLS), Selective Laser Melting (SLM), Electron Beam Melting (EBM), Fused Deposition Modeling (FDM), or a combination thereof.

In one embodiment, the additive manufacturing process includes the DMLM process. The DMLM process includes providing and depositing a metal alloy powder to form an initial powder layer having a preselected thickness and a preselected shape. A focused energy source (i.e., a laser or electron beam) is directed at the initial powder layer to melt the metal alloy powder and transform the initial powder layer to a portion of the lance 100 or one of its cooling features (e.g., microchannels 200).

Next, additional metal alloy powder is deposited sequentially in layers over the portion of the lance 100 to form additional layers having preselected thicknesses and shapes necessary to achieve the desired geometry. After depositing each additional layer of the metal alloy powder, the DMLM process includes melting the additional layer with the focused energy source to increase the combined thickness and form at least a portion of the lance 100. The steps of sequentially depositing the additional layer of the metal alloy powder and melting the additional layer may then be repeated to form the net or near-net shape lance 100.

While the majority of the air 18 flows through the outermost conduit 170 to be introduced through the tip portion 130 with the fuel (5 or 8) to convectively cool the body 102 and to mix with the fuel, a relatively small percentage of the air 18 is diverted into small air inlets (e.g., 202) of cooling microchannels (e.g., 200), as may be formed during the DMLM process described above. Air flowing through the microchannels produces a cooling film along the outer surface of the lance 100 in critical areas otherwise exposed to high temperatures due to exposure from the incoming hot combustion gases. By strategically placing the microchannels in these areas, the number of microchannels and the volume of cooling air may be advantageously reduced. Shorter microchannels (e.g., channels having a length of about 1 inch) may be used in higher temperature areas, while longer microchannels (e.g., channels having a length of about 2.5 to 3 inches) may be used in other areas.

A first set of these cooling microchannels 200 is disposed in the middle portion 140 of the lance 100 downstream of the balcony 106. As shown in FIGS. 6 and 7, some air inlets 202 direct air into microchannels 200*a* that extend transversely and wrap around a first side of the lance 100 and that terminate in air outlets 204 (visible in FIG. 3). Some air inlets 202 direct air into microchannels 200*b* that extend transversely wrap around a second (opposite) side of the lance 100 and that terminate in air outlets (not shown) on the opposite side. The air inlets 202 and their corresponding microchannels 200 are alternately arranged to maximize the surface area cooled.

FIGS. 8 and 9 illustrate microchannels 200*a* and 200*b*, which extend transversely about the upstream surface 142 of the vertically oriented middle portion 140. In FIG. 8, the microchannel 200*a* extends transversely in a first direction about the upstream surface 142, such that the air inlet 202 is disposed on the inner surface of a first side and the air outlet 204 is disposed on the outer surface of a second (opposite) side. In FIG. 9, the microchannel 200*b* extends transversely in a second direction about the upstream surface 142, such that the air inlet 202 is disposed on the inner surface of the second side and the air outlet 204 is disposed on the outer surface of the first side. Providing cooling flow in opposing directions helps to ensure that the area is adequately cooled.

FIGS. 5 through 7 and 10 illustrate a second set of cooling microchannels 210, which have inlets 212 proximate to the most downstream microchannel 200. The microchannels 210 extend in a generally axial direction toward or beyond a joint 145 between the middle portion 140 and the downstream portion 120. As shown in FIGS. 6 and 7, the air inlets 212 may be disposed in the same plane, while the air outlets 214, 216 may be disposed in different planes. The air outlets 214 are disposed in a plane proximate the joint 145, and the air outlets 216 are disposed downstream of the joint 145 to ensure cooling of the corner of the body 102. The longer microchannels 210 (i.e., those having air outlets 216) are closest to an upstream surface 142 of the vertically oriented section 140 of the body 102, which is exposed to the incoming flow of combustion gases from the first turbine section. The outlets 214, 216 may be seen in FIG. 3.

FIGS. 6 and 7 also illustrate a third set of microchannels 220, which have air inlets 222 disposed in alternating arrangement between the air outlets 214 of the second set of microchannels 210 or between the microchannels 210 having the air outlets 216. It should be recognized that the air inlets 222 are disposed on the inward surface of the body 102, while the air outlets 214, 216 are disposed on the outer surface of the body 102. The air inlets 222 are disposed in the same general plane proximate to the joint 145. The microchannels 220 may be of different lengths to optimize the cooling flow around the joint 145 and the corner of the body 102, thus resulting in air outlets 224 in different planes. The outlets 224 may be seen in FIG. 3.

FIGS. 5, 6, and 11 illustrate a fourth set of cooling microchannels 230 that extend along the curved lower surface 124 of the downstream portion 120 of the lance 100. Each microchannel 230 extends between an air inlet 232 on an inner surface of the curved lower surface 124 and an air outlet 234 on an outer surface of the curved lower surface 124. The outlet 234 of one such microchannel 230 may be seen in FIG. 3.

FIGS. 5, 6, 12, and 13 illustrate a fifth set of cooling microchannels 240 that are disposed at the tip portion 130 of the lance 100. In one embodiment, the cooling microchannels 240 extend from an air inlet 242 disposed on an inner surface of the tip portion 130 to an air outlet 244 on the outer surface of the tip portion 130 (as shown in FIG. 5).

FIGS. 5, 6, and 14 illustrate a sixth set of cooling microchannels 250 that are disposed in the balcony 106 of the lance 100. Each of these microchannels includes and extends in a generally transverse direction between an air inlet 252 in an upper surface 106*a* and an air outlet 254 in a lower surface 106*b*. The microchannel 250 is positioned proximate to the lower surface 106*b* to achieve near-surface cooling of the lower surface 106*b*, which is exposed to higher temperatures.

In many fuel lances having a cold fuel conduit disposed within a hotter outer conduit, the thermal discrepancy between the components can lead to wear that shortens the useful life of the lance. In the present lance 100, a self-centering fixation system 300 is disposed in the passage 174 between the outer surface of the intermediate conduit 160 and the inner surface of the outermost conduit 170. The fixation system 300, which is located along the longitudinal axis 101 of the lance 100, permits movement of the conduits 160, 170 along the longitudinal axis 131 of the downstream portion 120 and the tip portion 130. Movement along the radial direction of the downstream portion 120 (and, therefore, along the longitudinal axis 101 of the lance 100) is prevented.

The fixation system 300 includes hook-shaped elements 302, 304, 306, 308 and T-shaped pegs 310. The hook-shaped elements 302, 304, 306, 308 extend radially inward from the outermost conduit 170 and are arranged in pairs 302/304 and 306/308. The hook-shaped elements 302 and 304 are axially spaced from one another, and the hook-shaped elements 306 and 308 are axially spaced from one another. The hook-shaped elements 302 and 304 are circumferentially spaced from the hook-shaped elements 306 and 308, such that element 302 is opposite element 306 and element 304 is opposite element 308. The length of each T-shaped peg 310 spans the spacing of the hook-shaped elements 302, 304 and 306, 308.

Although the fixation system 300 is illustrated with four sets of hook-shaped elements 302-308 and T-shaped pegs 310, the number of sets may vary.

Exemplary embodiments of the present dual-fuel lance with cooling microchannels are described above in detail. The components described herein are not limited to the specific embodiments described herein, but rather, aspects of the methods and components may be utilized independently and separately from other components described herein. For example, the components described herein may have other applications not limited to practice with annular combustors for power-generating gas turbines, as described herein. Rather, the components described herein can be implemented and utilized in various other industries.

While the technical advancements have been described in terms of various specific embodiments, those skilled in the art will recognize that the technical advancements can be practiced with modification within the spirit and scope of the claims.

What is claimed is:

1. A lance for a burner comprising:

an innermost conduit defining a first fluid passage and a plurality of first fuel injection channels, each first fuel injection channel terminating at a first outlet;

an intermediate conduit circumferentially surrounding the innermost conduit, the intermediate conduit defining a second fluid passage and a plurality of second fuel injection channels, each second fuel injection channel terminating at a second outlet;

an outermost conduit circumferentially surrounding the intermediate conduit, the outermost conduit defining a third fluid passage, a plurality of third air outlets through the outermost conduit and surrounding the first outlets, a plurality of fourth air outlets through the outermost conduit and surrounding the second outlets, and a plurality of cooling microchannels disposed in areas prone to high temperatures during operation;

wherein the innermost conduit, the intermediate conduit, and the outermost conduit have respective conduit inlets co-axial with a longitudinal axis of the lance;

wherein each of the innermost conduit, the intermediate conduit, and the outermost conduit comprises an upstream arcuate portion fluidly connected to the respective conduit inlet; a vertically oriented portion fluidly connected to the upstream arcuate portion and parallel to the longitudinal axis; and a downstream portion fluidly connected to the vertically oriented portion and transverse to the longitudinal axis, wherein the respective downstream portions of each of the innermost conduit, the intermediate conduit, and the outermost conduits comprise an upper curved surface and a lower curved surface;

wherein the innermost conduit, the intermediate conduit, and the outermost conduit terminate in a tip portion that is perpendicular to the longitudinal axis of the lance;

wherein each cooling microchannel includes and extends between a microchannel inlet defined through the outermost conduit and in fluid communication with the third fluid passage of the outermost conduit and a microchannel outlet on an outer surface of the outermost conduit to produce a cooling film along the outer surface; and wherein the plurality of cooling microchannels comprises a first set of cooling microchannels disposed in the vertically oriented portion of the outermost conduit; and wherein the first set of cooling microchannels are oriented in a transverse direction across an upstream surface of the vertically oriented portion.

2. The lance of claim 1, wherein the plurality of cooling microchannels comprises a second set of cooling microchannels disposed in the tip portion of the outermost conduit.

3. The lance of claim 2, wherein the respective microchannel inlets of the second set of cooling microchannels are disposed in a circumferential array downstream of the longitudinal axis of the lance; and wherein the respective microchannel outlets of the second set of cooling microchannels are disposed proximate to a lance tip of the tip portion.

4. The lance of claim 1, wherein the tip portion is part of the downstream portion of the lance; and wherein the upper curved surface and the lower curved surface of each respective conduit curve toward one another and are joined at a lance tip.

5. The lance of claim 1, wherein the respective microchannel inlets of a first sub-set of the first set of cooling microchannels are disposed on a first side of the upstream surface of the outermost conduit, and the respective microchannel outlets of the first sub-set of the first set of cooling microchannels are disposed on a second side of the upstream surface of the outermost conduit; and wherein the respective microchannel inlets of a second sub-set of the first set of cooling microchannels are disposed on the second side of the upstream surface of the outermost conduit, and the respective microchannel outlets of the second sub-set of the first set of cooling microchannels are disposed on the first side of the upstream surface of the outermost conduit.

6. The lance of claim 5, wherein the respective microchannel inlets of the first sub-set of the first set of cooling microchannels are alternately arranged with the respective microchannel outlets of the second sub-set of the first set of cooling microchannels; and wherein the respective microchannel outlets of the first sub-set of the first set of cooling microchannels are alternately arranged with the respective microchannel outlets of the second sub-set of the first set of cooling microchannels.

7. The lance of claim 1, wherein the plurality of cooling microchannels comprises a third set of cooling microchannels extending in a direction generally parallel to the longitudinal axis; and wherein the respective microchannel inlets of the third set of cooling microchannels are disposed in a common plane within the vertically oriented portion of the outermost conduit.

8. The lance of claim 7, wherein the respective microchannel outlets of a first sub-set of the third set of cooling microchannels are disposed upstream of a joint between the vertically oriented portion and the downstream portion of the outermost conduit; and wherein the respective outlets of a second sub-set of the third set of cooling microchannels are disposed downstream of the joint between the vertically oriented portion and the downstream portion of the outermost conduit.

9. The lance of claim 8, wherein the plurality of cooling microchannels comprises a fourth set of cooling microchannels disposed in the downstream portion proximate to the joint between the vertically oriented portion and the downstream portion of the outermost conduit; and wherein the respective microchannel inlets of the fourth set of cooling microchannels are disposed in an alternating arrangement with the respective microchannels outlets of the first sub-set of the third set of cooling microchannels.

10. The lance of claim 1, further comprising a support arm coupled to an upstream end of the upstream arcuate portion of the outermost conduit and a balcony extending from the vertically oriented portion of the outermost conduit to the support arm.

11. The lance of claim 10, wherein at least one additional cooling microchannel extends in a generally transverse direction through the balcony in closer proximity to a lower surface of the balcony than an upper surface of the balcony, the at least one additional cooling microchannel having a microchannel inlet along the upper surface of the balcony and a microchannel outlet along the lower surface of the balcony.

12. A lance for a burner comprising:

an innermost conduit defining a first fluid passage and a plurality of first fuel injection channels, each first fuel injection channel terminating at a first outlet;

an intermediate conduit circumferentially surrounding the innermost conduit, the intermediate conduit defining a second fluid passage and a plurality of second fuel injection channels, each second fuel injection channel terminating at a second outlet;

an outermost conduit circumferentially surrounding the intermediate conduit, the outermost conduit defining a third fluid passage, a plurality of third air outlets through the outermost conduit and surrounding the first outlets, a plurality of fourth air outlets through the outermost conduit and surrounding the second outlets, and a plurality of cooling microchannels disposed in areas prone to high temperatures during operation;

wherein the innermost conduit, the intermediate conduit, and the outermost conduit have respective conduit inlets co-axial with a longitudinal axis of the lance;

wherein each of the innermost conduit, the intermediate conduit, and the outermost conduit comprises an upstream arcuate portion fluidly connected to the respective conduit inlet; a vertically oriented portion fluidly connected to the upstream arcuate portion and parallel to the longitudinal axis; and a downstream portion fluidly connected to the vertically oriented portion and transverse to the longitudinal axis, wherein the respective downstream portions of each of the innermost conduit, the intermediate conduit, and the outermost conduit comprise an upper curved surface and a lower curved surface;

wherein the innermost conduit, the intermediate conduit, and the outermost conduit terminate in a tip portion that is perpendicular to the longitudinal axis of the lance;

wherein each cooling microchannel includes and extends between a microchannel inlet defined through the outermost conduit and in fluid communication with the third fluid passage of the outermost conduit and a microchannel outlet on an outer surface of the outermost conduit to produce a cooling film along the outer surface; and wherein the plurality of cooling microchannels comprises a first set of cooling microchannels extending in a direction generally parallel to the longitudinal axis; and wherein the respective microchannel inlets of the first set of cooling microchannels are disposed in a common plane within the vertically oriented portion.

13. The lance of claim 12, wherein the respective microchannel outlets of a first sub-set of the first set of cooling microchannels are disposed upstream of a joint between the vertically oriented portion and the downstream portion of the outermost conduit; and wherein the respective outlets of a second sub-set of the first set of cooling microchannels are disposed downstream of the joint between the vertically oriented portion and the downstream portion of the outermost conduit.

14. The lance of claim 13, wherein the plurality of cooling microchannels comprises a second set of cooling microchannels disposed in the downstream portion proximate to the joint between the vertically oriented portion and the downstream portion of the outermost conduit; and wherein the respective microchannel inlets of the second set of cooling microchannels are disposed in an alternating arrangement with the respective microchannels outlets of the first sub-set of the first set of cooling microchannels.

15. The lance of claim 12, further comprising a support arm coupled to an upstream end of the upstream arcuate portion of the outermost conduit and a balcony extending from the vertically oriented portion of the outermost conduit to the support arm.

16. The lance of claim 15, wherein at least one additional cooling microchannel extends in a generally transverse direction through the balcony in closer proximity to a lower surface of the balcony than an upper surface of the balcony, the at least one additional cooling microchannel having a microchannel inlet along the upper surface of the balcony and a microchannel outlet along the lower surface of the balcony.

17. A lance for a burner comprising:

an innermost conduit defining a first fluid passage and a plurality of first fuel injection channels, each first fuel injection channel terminating at a first outlet;

an intermediate conduit circumferentially surrounding the innermost conduit, the intermediate conduit defining a second fluid passage and a plurality of second fuel injection channels, each second fuel injection channel terminating at a second outlet;

an outermost conduit circumferentially surrounding the intermediate conduit, the outermost conduit defining a third fluid passage, a plurality of third air outlets through the outermost conduit and surrounding the first outlets, a plurality of fourth air outlets through the outermost conduit and surrounding the second outlets, and a plurality of cooling microchannels disposed in areas prone to high temperatures during operation;

wherein the innermost conduit, the intermediate conduit, and the outermost conduit have respective conduit inlets co-axial with a longitudinal axis of the lance;

wherein each of the innermost conduit, the intermediate conduit, and the outermost conduit comprises an upstream arcuate portion fluidly connected to the respective conduit inlet; a vertically oriented portion fluidly connected to the upstream arcuate portion and parallel to the longitudinal axis; and a downstream portion fluidly connected to the vertically oriented portion and transverse to the longitudinal axis and having a fixation system disposed within the downstream portion between the outermost conduit and the intermediate conduit, wherein the respective downstream portions of each of the innermost conduit, the intermediate conduit, and the outermost conduit comprise an upper curved surface and a lower curved surface;

wherein the innermost conduit, the intermediate conduit, and the outermost conduit terminate in a tip portion that is perpendicular to the longitudinal axis of the lance;

wherein each cooling microchannel includes and extends between a microchannel inlet defined through the outermost conduit and in fluid communication with the third fluid passage of the outermost conduit and a microchannel outlet on an outer surface of the outermost conduit to produce a cooling film along the outer surface; and wherein the fixation system comprises circumferentially spaced sets of hook-shaped elements extending radially inward from the outermost conduit and corresponding T-shaped pegs extending radially outward from the intermediate conduit, each T-shaped peg being disposed within a respective set of hook-shaped elements.

18. The lance of claim 17, wherein each set of hook-shaped elements comprises four hook-shaped elements arranged as opposing pairs.

19. The lance of claim 17, wherein the plurality of cooling microchannels comprises one or more of:

a first set of cooling microchannels disposed in the vertically oriented portion of the outermost conduit; and wherein the first set of cooling microchannels are oriented in a transverse direction across an upstream surface of the vertically oriented portion;

a second set of cooling microchannels disposed in the tip portion of the outermost conduit;

a third set of cooling microchannels extending in a direction generally parallel to the longitudinal axis, the respective microchannel inlets of the third set of cooling microchannels being disposed in a common plane within the vertically oriented portion; and a fourth set of cooling microchannels disposed in the downstream portion proximate to a joint between the vertically oriented portion and the downstream portion.

* * * * *